US007370378B2

(12) United States Patent
Nakasato et al.

(10) Patent No.: US 7,370,378 B2
(45) Date of Patent: May 13, 2008

(54) NECK-HEAD SUPPORT PILLOW

(76) Inventors: Osamu Nakasato, 3-31-36 Nishiyama, Nagasaki-shi, Nagasaki (JP); Takashi Nakasato, 3-31-36 Nishiyama, Nagasaki-shi, Nagasaki (JP)

( * ) Notice: Subject to any disclaimer, the term of this patent is extended or adjusted under 35 U.S.C. 154(b) by 58 days.

(21) Appl. No.: 10/566,335

(22) PCT Filed: Oct. 6, 2003

(86) PCT No.: PCT/JP03/12795

§ 371 (c)(1),
(2), (4) Date: Jan. 27, 2006

(87) PCT Pub. No.: WO2005/009182

PCT Pub. Date: Feb. 3, 2005

(65) Prior Publication Data

US 2006/0213012 A1 Sep. 28, 2006

(30) Foreign Application Priority Data

Jul. 29, 2003 (JP) ..... 2003-309414

(51) Int. Cl.
*A47G 9/10* (2006.01)

(52) U.S. Cl. ..... 5/636; 5/640; 5/645; 5/657

(58) Field of Classification Search ..... 5/636, 5/639, 640, 644, 645
See application file for complete search history.

(56) References Cited

U.S. PATENT DOCUMENTS

| | | | | | |
|---|---|---|---|---|---|
| 1,385,355 | A * | 7/1921 | Banks | ..... | 5/636 |
| 2,577,595 | A * | 12/1951 | Tobias | ..... | 5/632 |
| 3,061,844 | A * | 11/1962 | Coursey | ..... | 5/640 |
| 3,849,810 | A * | 11/1974 | Degen | ..... | 5/640 |
| 4,649,582 | A * | 3/1987 | Cho | ..... | 5/640 |

* cited by examiner

*Primary Examiner*—Michael Trettel
(74) *Attorney, Agent, or Firm*—Ladas & Parry LLP

(57) ABSTRACT

In an existing pillow, when the user makes a return to on-the-back lying from on-the-side lying, a strain forms in a region associated with on-the-side lying, so that an elasticity-less material, such as chaff, pipes or the like cannot perfectly adjust the sinking of the pillow under the weight of the neck. The inventive pillow consists of a total three divisions, one for the neck and two for the head. Thus, even if the user moves from on-the-side lying to on-the-back lying, the head and neck enter the recesses in the three divisions, thus eliminating the possibility of a strain forming in a region associated with on-the side-lying. Minus surface fasteners are attached to the pillow back for the neck and the head, while plus surface fasteners are attached to the outer seams in the divisions for the neck and head; thus, the sinking rises as at by squeezing as at for center movement, and the problem of too much rising is solved by loosening as at for outer movement and fixing the plus and minus surface fasteners. If combined with my Japanese Utility Model Application No. 2001-002267 U and Japanese Patent No. 2001-333518 A and FIG. 19 (19, 28), this invention provides a pillow that adapts itself to the neck and head for all people in the world.

4 Claims, 10 Drawing Sheets

FIGURE # 1
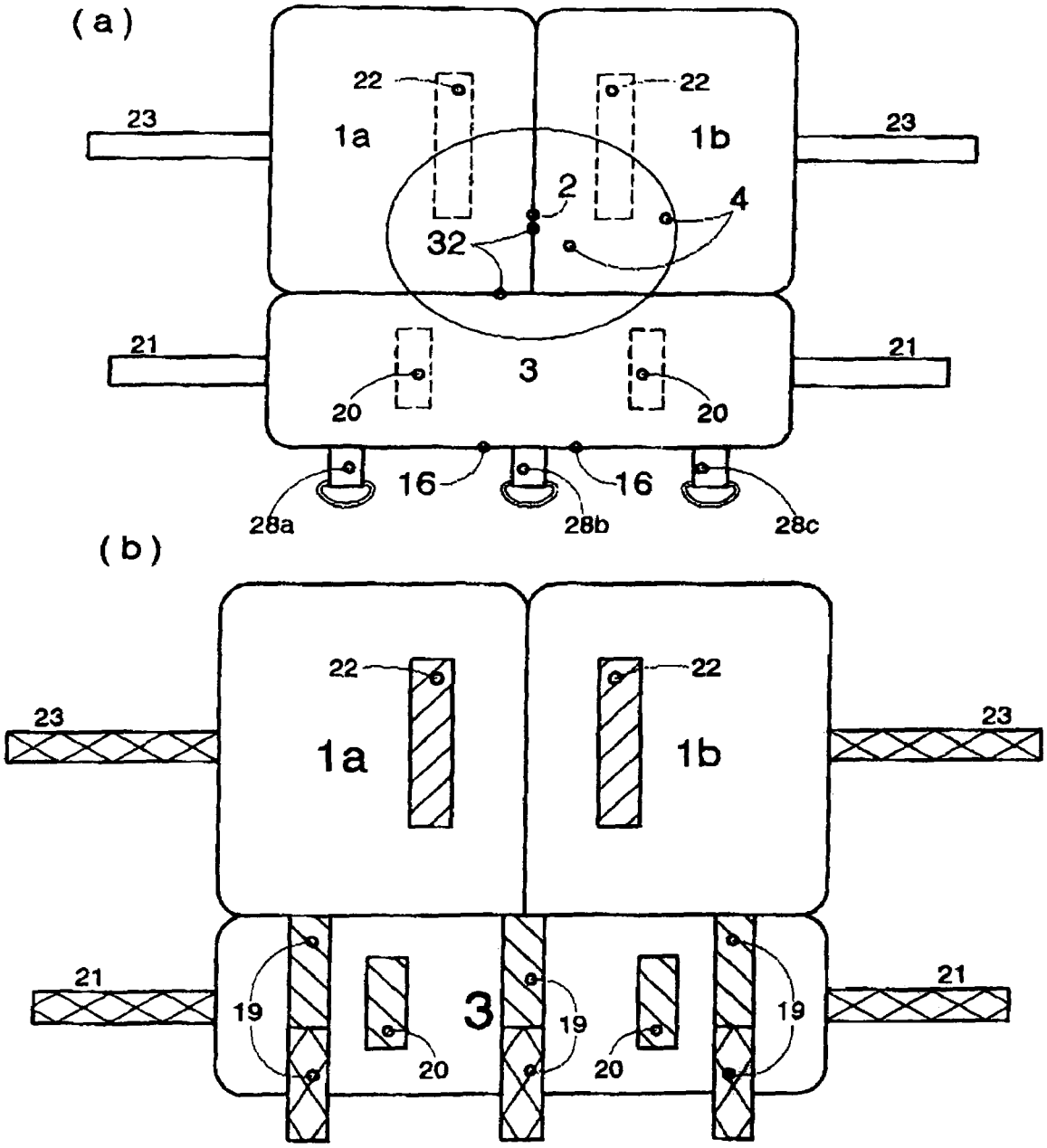

FIGURE #2
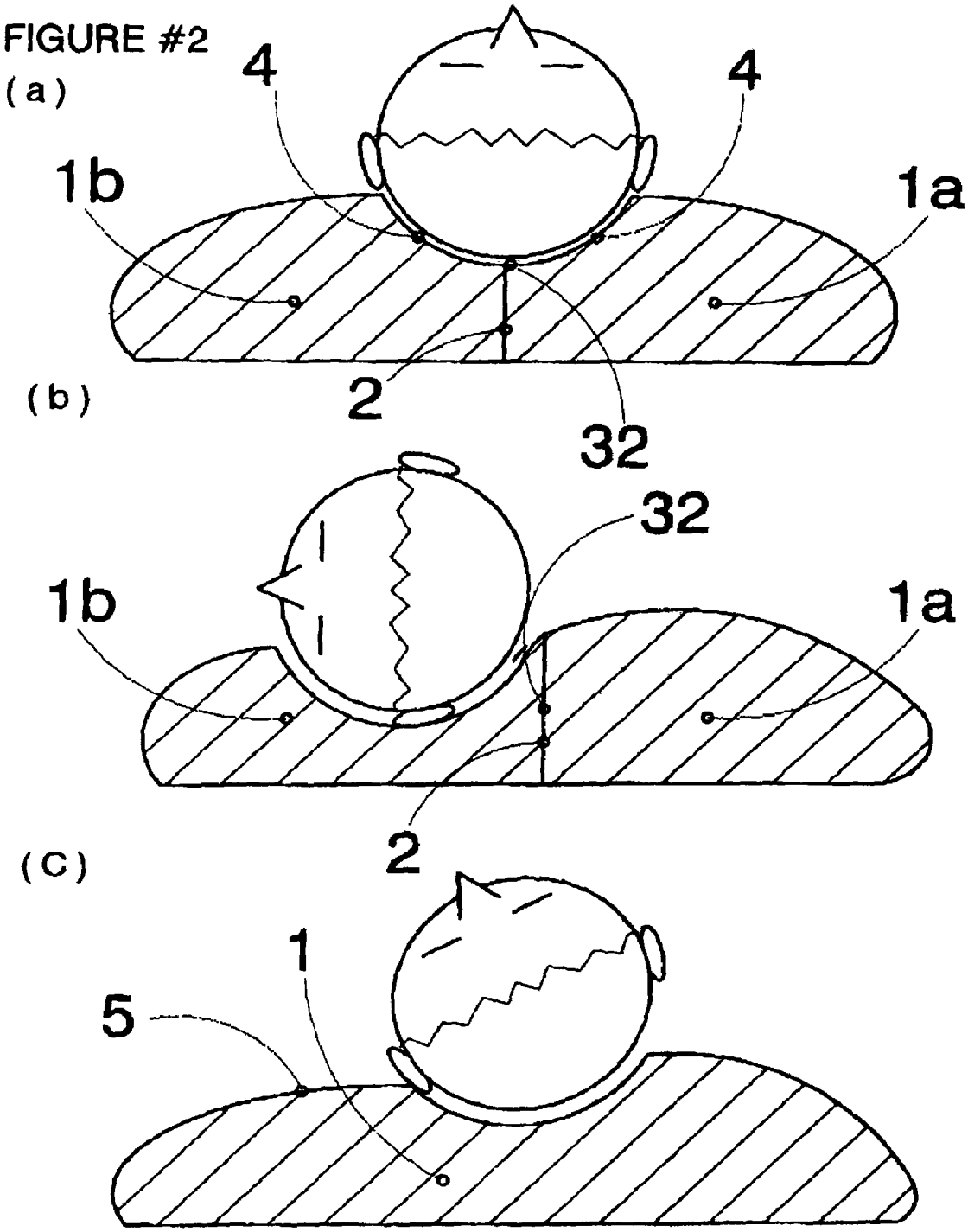

FIGURE #3
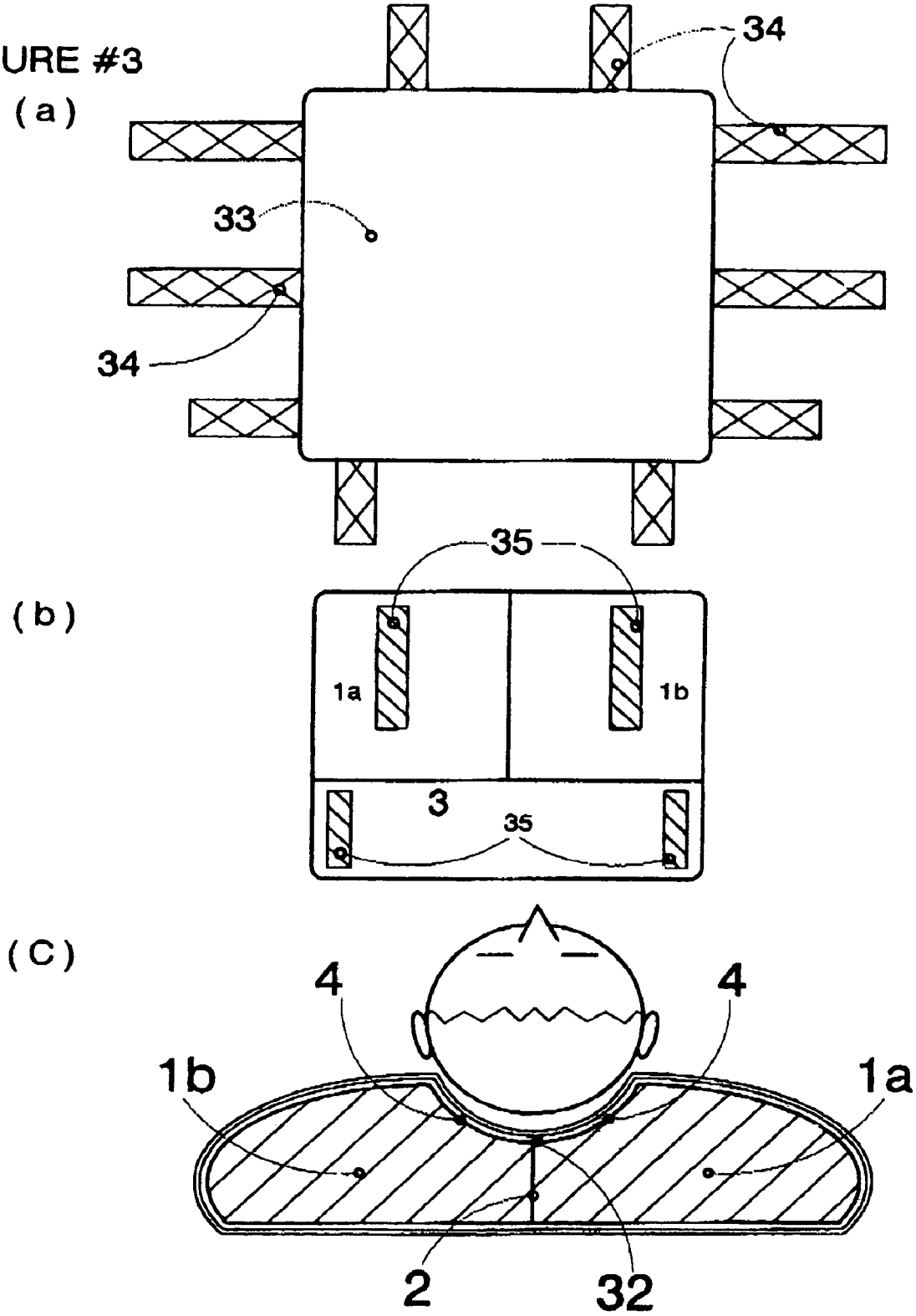

FIGURE #4
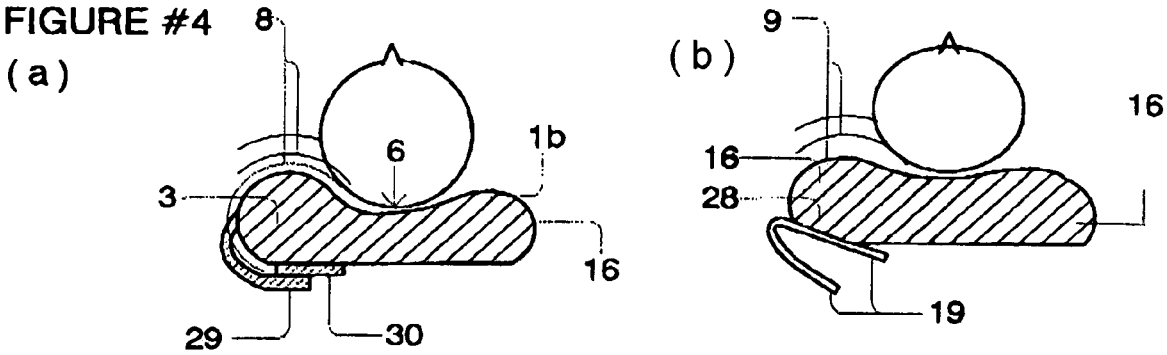
FIGURE #5
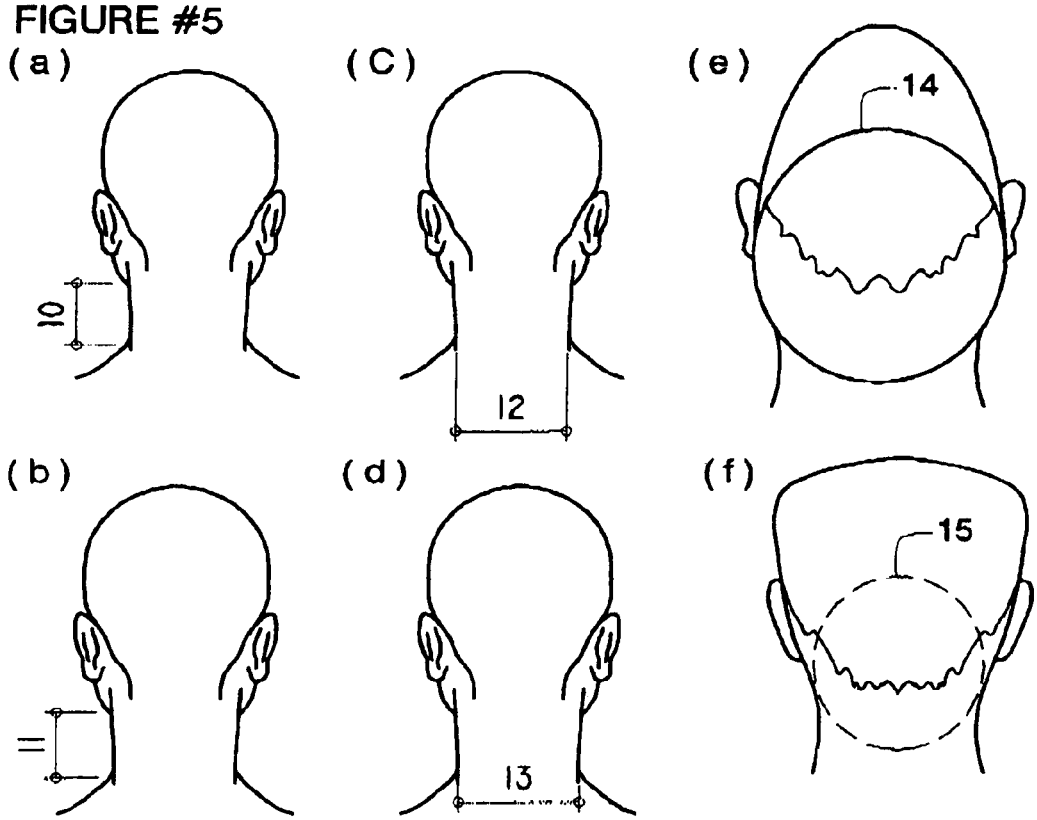

FIGURE #6
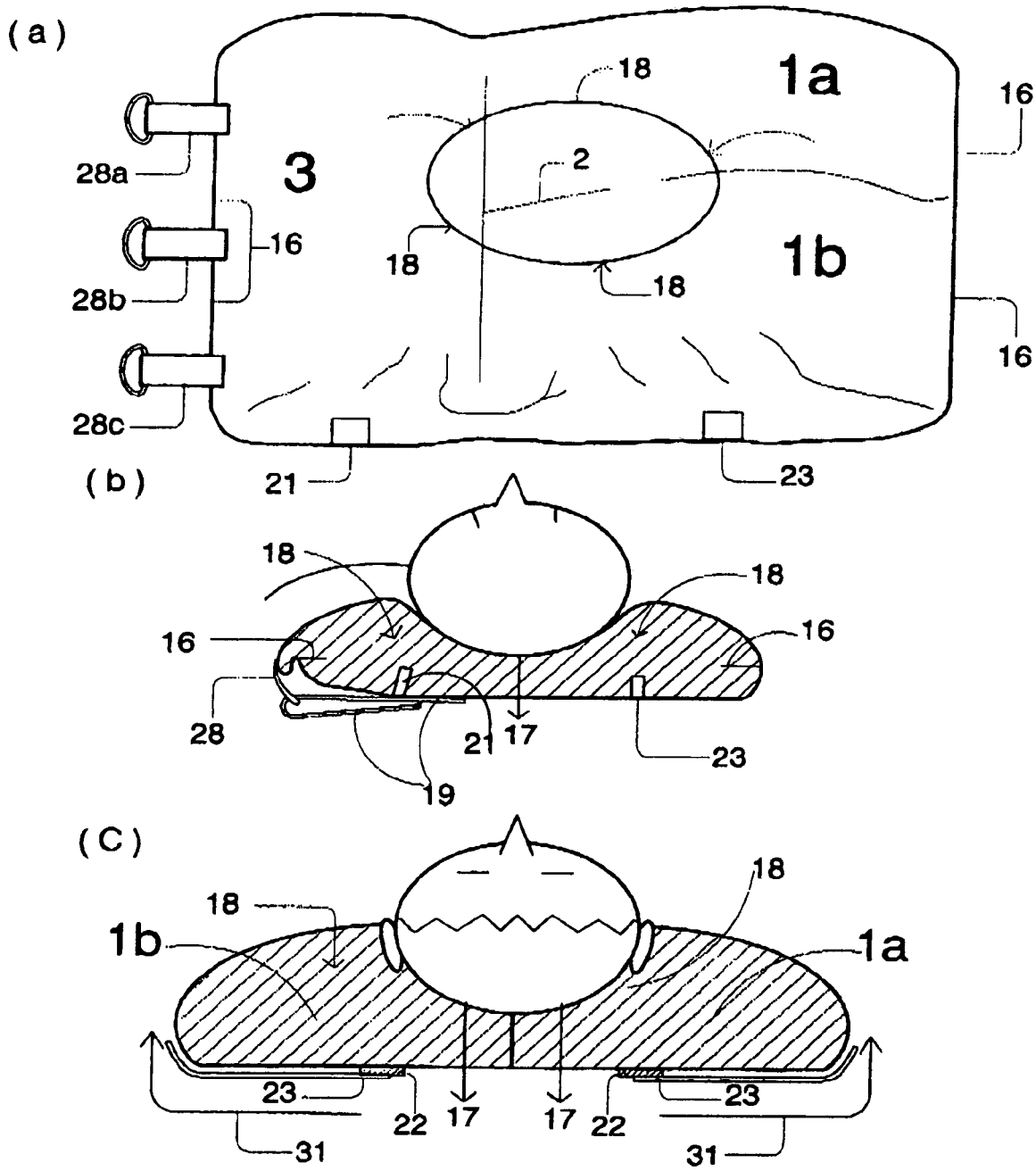

FIGURE #7
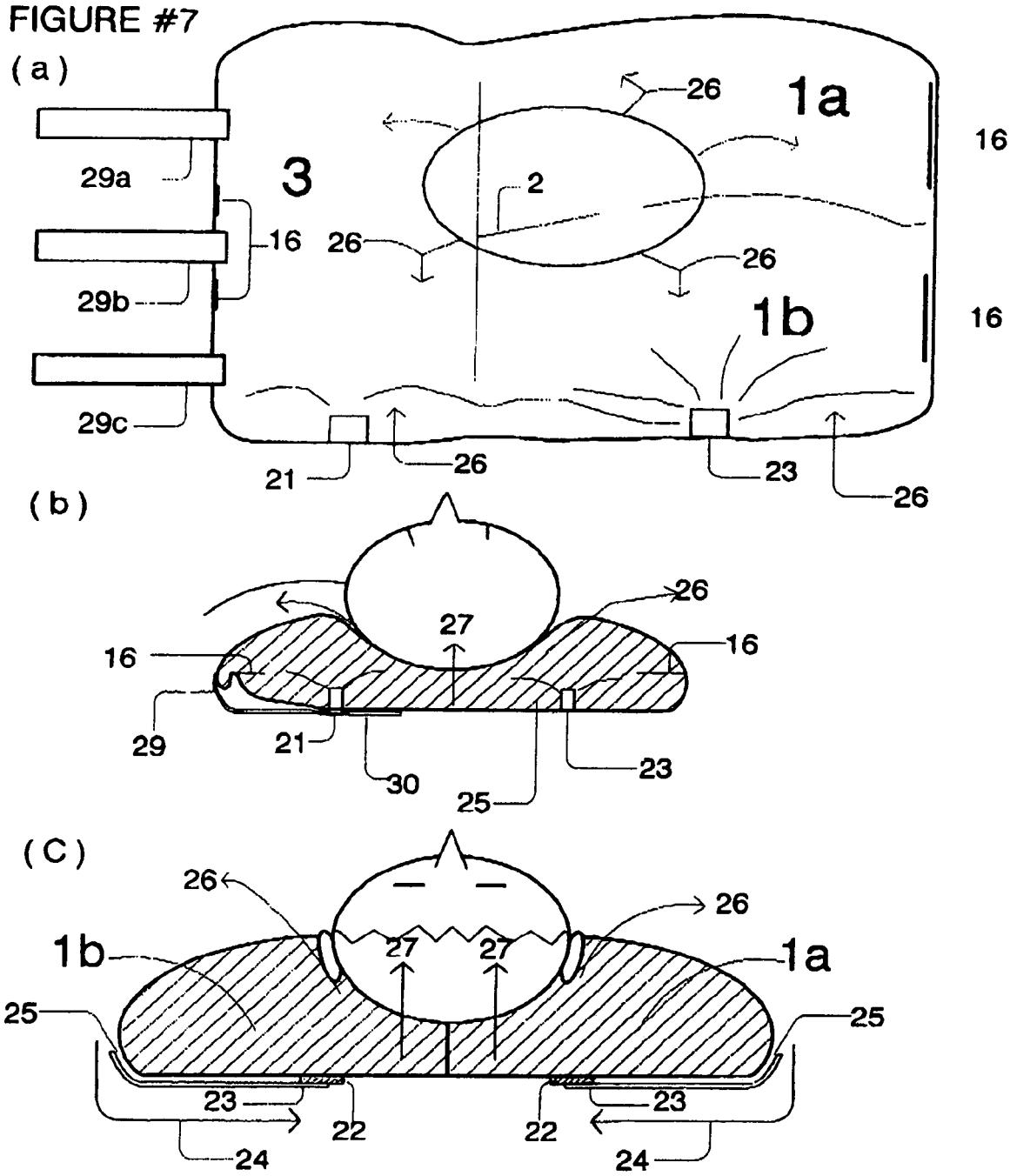

FIGURE # 8
(a)
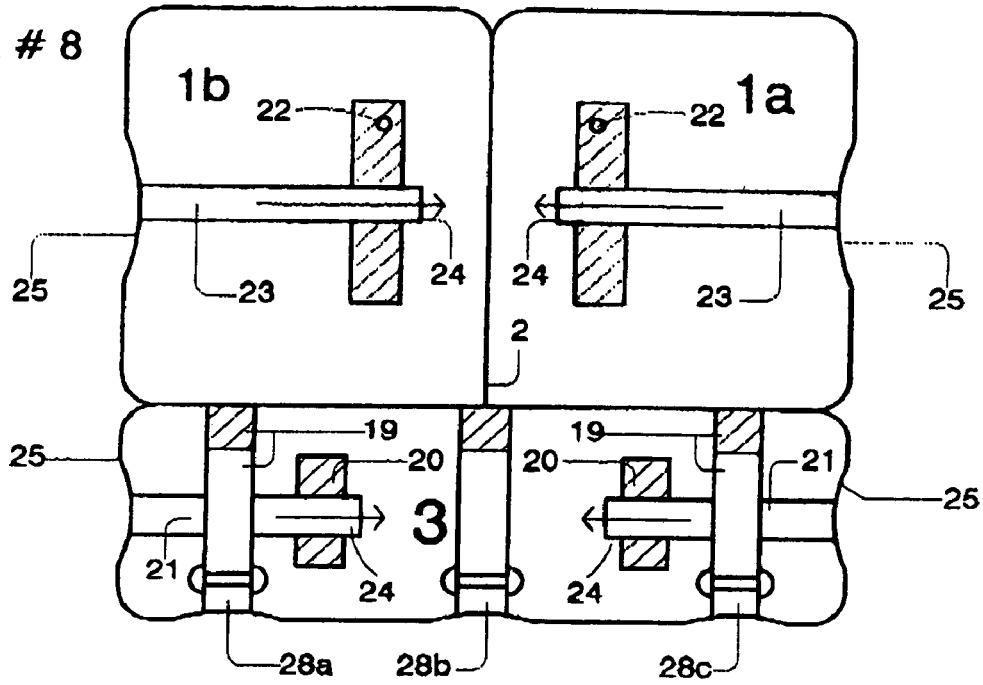
(b)
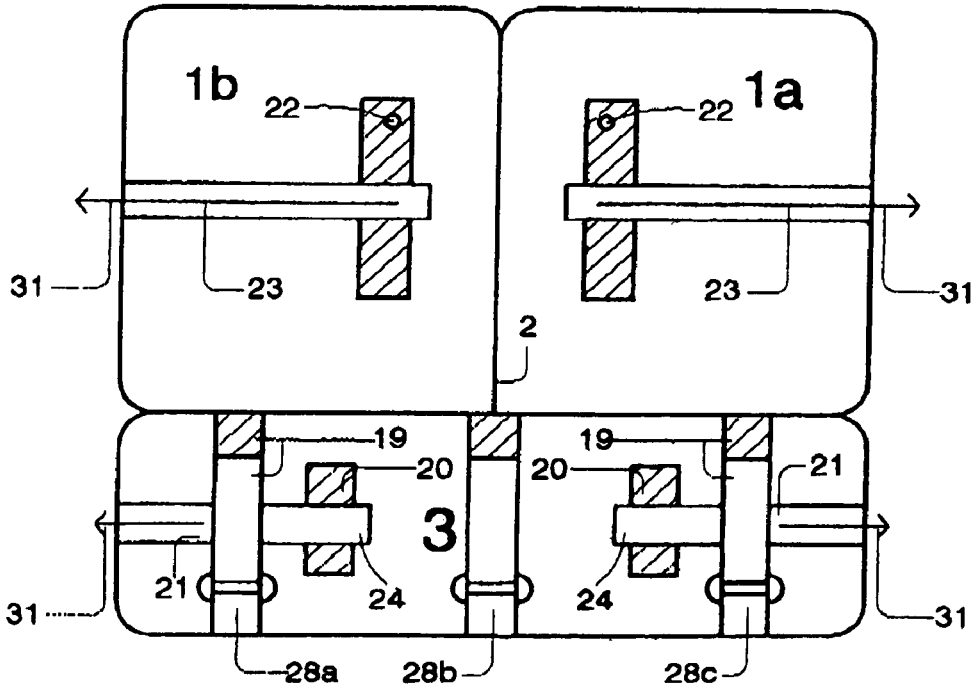

FIGURE # 9
(a)
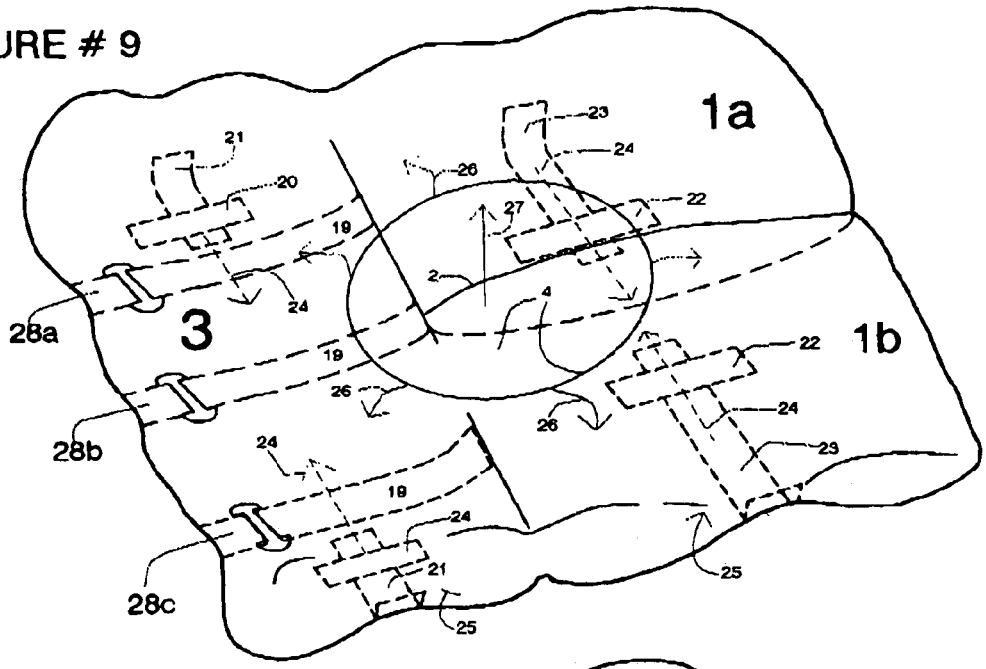
(b)
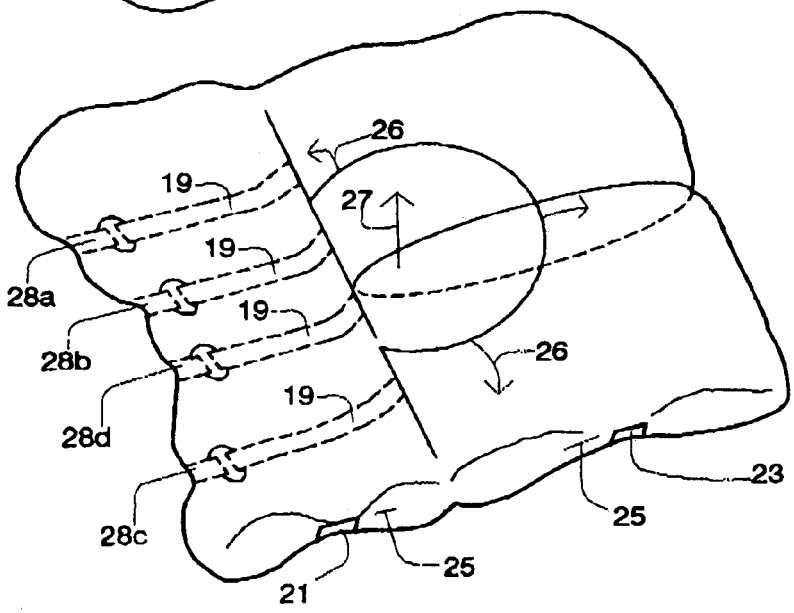

FIGURE # 10
(a)
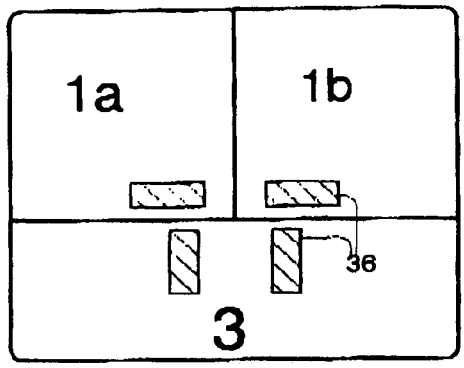
(b)
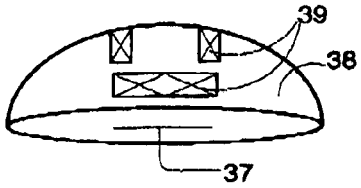
(c)
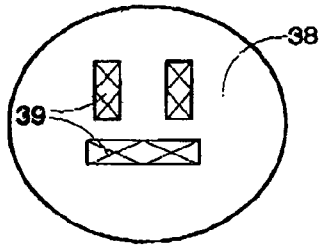
(d)
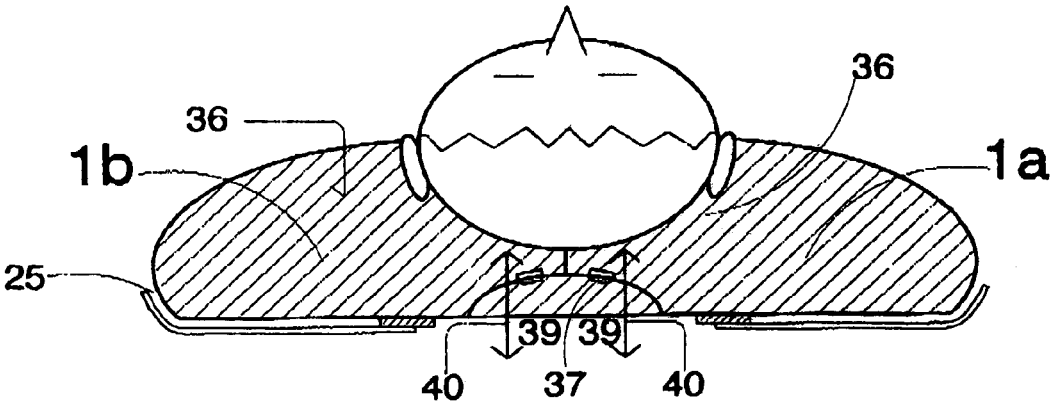

FIGURE # 11
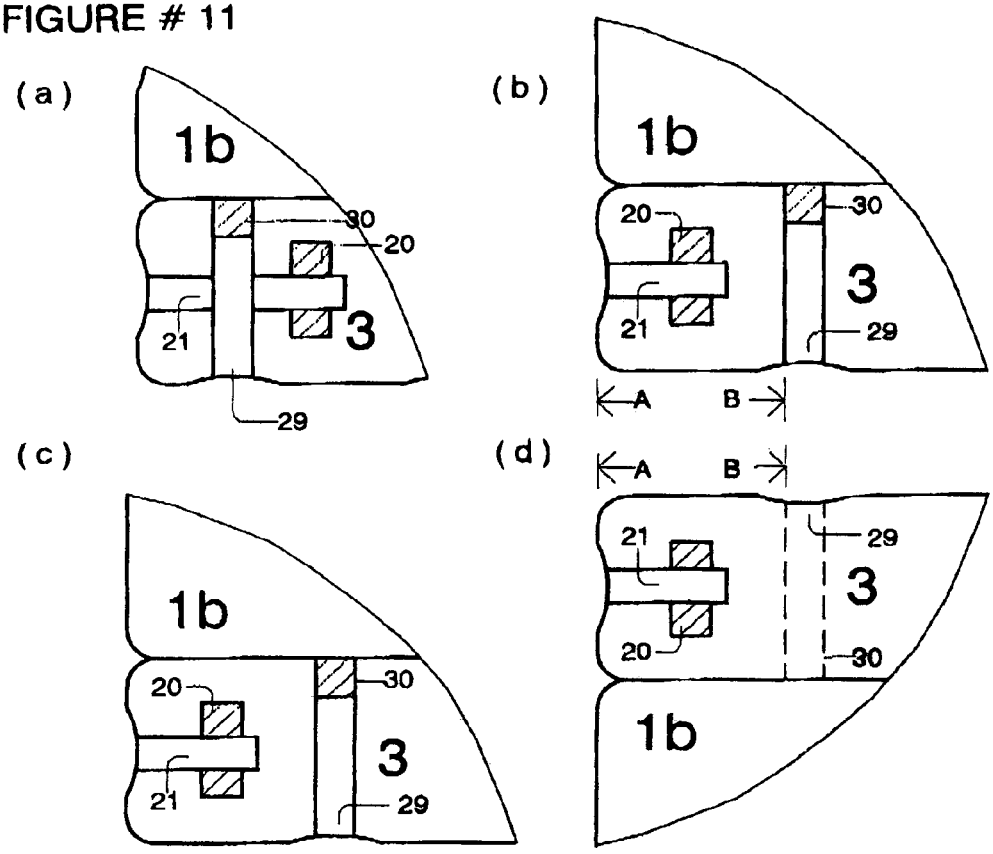
FIGURE # 12
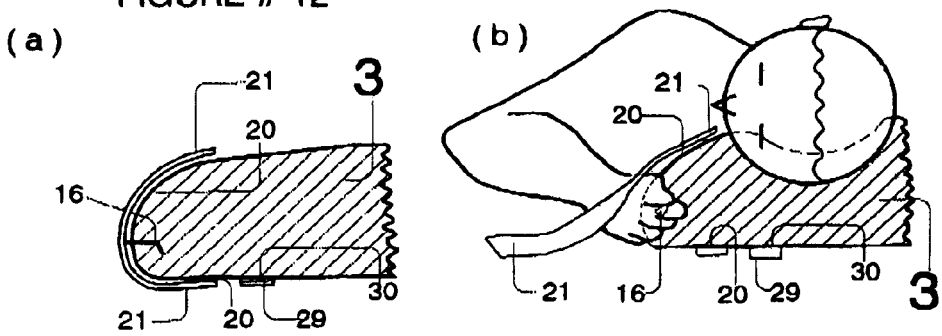

NECK-HEAD SUPPORT PILLOW

FIELD OF INVENTION

People go through a number of positions when sleeping, from lying on the side to lying on the back facing the ceiling. Ordinary pillow becomes deformed on places where the head and neck are constantly positioned. Presented here is an adjustable three-paneled Neck-Head Support Pillow that can be made to conform to any size and shape neck and head.

BACKGROUND OF INVENTION

Viewed from the side, it can be observed that a recumbent person's body attains a posture that is O-shaped from the cranial bones and S-shaped from the cervical vertebrae to the tip of the spine. There is a support pillow that responds to this posture by having adjustable height. (Refer to Patent Document 1 and Utility Model 1) I, Osamu Nakasato, designed a pillow that not only the height but also the width can be adjusted. The pillow is intended to fit any size and shape of head and neck. (Refer to Patent Document 2 and Utility Model 2)

The pillow available to people today is filled with pipe or chaff. They are not resilient and cannot retain their original shape; one side of the pillow becomes dented after some time. A good pillow should keep its mound shape as a person shifts to different sleeping position. Mr. Kiyohisa Takahashi, president of the National Center of Neurology and Psychology in Japan, in an interview with Kyodo News Service Newspaper on Apr. 12, 2002 stated that "In Japan 1 out of 5 people have trouble sleeping." Uncomfortable pillow can be one of the causes of a person having difficulty sleeping. Mental stress, because of excessive thinking, among others can also contribute to people having restless sleep.

In the investigation of Japan Patent Office, it is determined that no one pillow with both adjustable height and width is available in the market as of Jul. 28, 2003.

| | |
|---|---|
| [Patent Document 1] | Patent Official Report 2873019 (Clause 2, FIG. 1 and FIG. 2) |
| [Utility Model Document 1] | Utility Model Official Registration Report 3011499 (Clause 2, FIG. 1 and FIG. 3) |
| [Patent Document 2] | Registration of Official Report of 2003-093212 (Clause 1, FIG. 1) |
| [Utility Model Document 2] | Utility Model Official Report 3081155 (Clause 1, FIG. 1) |

The Neck-Head Support Pillow presented here satisfies the need of different types of people of varying sizes. One pillow can be adjusted to solve the problem of the 3081155 and 2003-093212 pillows patented to me, Osamu Nakasato. It offers support to the head and neck and contours to the shape and size of the neck and head of the person using it.

BRIEF DESCRIPTION OF THE INVENTION

The devise is divided into three panels; one panel forming the cervical pillow traverses the whole width at the bottom of the devise and comprises one third of the height supports the neck, while two panels equally divides the upper part of the devise support the head. When lying down on one's back with the head facing the ceiling, the head is comfortably nestled in the indentation in the middle of the two upper panels while the panel at the bottom supports the neck. Turning at the right side will put the head on one of the upper panels while the bottom depresses suitably to hold up the neck. In shifting to lying-on-the-back position, the dent made by the head on the panel will immediately return to its normal shape. The invention is designed to sustain the three positions of the head. Attached at the back of the pillow are strategically placed hook-and-loop fasteners that functions as the adjusting mechanism to attain the desired height and width. The bottom cervical pillow part has three straps with plastic rings at the end attached at interval to the bottom edge of the pillow and corresponding positive/negative hook-and-loop fasteners affixed to the backside that are used to control the height to correspond to 6,300,000,000 different neck shapes and sizes. Two straps with the positive side hook-and-loop fastener are placed at both sides of the cervical pillow that are attached to the negative fastener affixed at the backside that controls the width. Each of the two upper panels has positive hook-and-loop fastener at the sides that are locked on to the negative hook-and-loop fastener near the inner border of each panel that controls the height of the head. A small pillow can be attached in the groove between the three panels to give support for flat-shaped head. Each of the three panels has openings at the bottom sealed by zippers for the user to be able to adjust the fillers of the pillow. These adjustable features are designed to give users unlimited control over the height and width of their pillows giving them more comfortable and trouble-free sleep.

BRIEF DESCRIPTION OF THE DRAWINGS

"FIG. 1"

(a) Diagram of the implementation of the invention (front)

(b) Diagram of the implementation of the invention (back)

"FIG. 2"

(a) Diagram of the use of the invention with the person lying on his back and the longitudinal section of the upper two panel of the pillow (b) Diagram of the use of the invention with the person lying on his side and the cross section view of the upper two panels of the pillow (c) Diagram of the longitudinal section of an ordinary pillow showing the slight depression made by the head when it return to the lying-on-back position from side-lying position

"FIG. 3"

(a) Diagram of the implementation of the invention (front)

(b) Diagram of the implementation of the invention (back)

(c) Diagram of the longitudinal section of the invention showing the indentation made by the head of a person when lying on his back and the fasteners attached to the pillow

"FIG. 4"

(a) Diagram of the side view of Utility Model Registration No. 3081155 and how the cervix and rounded head are placed (b) Diagram of the side view of Patent No. 2003-093212 and how the cervix and flat head are placed in the pillow

"FIG. 5"

(a) (b) (c) (d) (e) (f) Diagram of different shapes and sizes of cervix and head

"FIG. 6"

(a) Diagram of the oblique perspective of the implementation of the invention (b) Diagram of the invention with the view from the side showing how the devises is used (c) Diagram of the longitudinal section of the invention (top view) showing how the devise is used

"FIG. 7"

(a) Diagram of the oblique perspective of the implementation of the invention (b) Diagram of the invention with the view from the side showing how the devise is used (c) Diagram of the longitudinal section of the invention (top view) showing the devise is used

"FIG. 8"

(a) (b) Diagram of the implementation of the invention (back)

"FIG. 9"

(a) (b) Diagram of the oblique perspective showing the implementation of the invention

"FIG. 10"

(a) Diagram showing the implementation of the invention (back)

(b) Diagram of the oblique perspective showing the implementation of the invention (c) Diagram of the implementation of the invention (front)

(d) Diagram of the implementation of the invention (top view) showing how the devise is used

"FIG. 11"

(a) (b) (c) Diagram of the plane view of the cervical pillow part (back) showing the implementation of the invention (d) Diagram of the plane view of the cervical pillow and left head part (front) showing the implementation of the invention

"FIG. 12"

(a) Diagram of the longitudinal section (top view) showing the implementation of the invention (b) Diagram of the longitudinal section (top view) showing the implementation of the invention

DESCRIPTION OF NOTATIONS

1*a* Right of back of the head
1*b* Left of back of the head
2 The groove in the middle of the two upper panels
7 Back of the head flat
8 Cervix
9 Cervix
10 Short Cervix (height)
11 Long Cervix (height)
12 Short Cervix (Width)
13 Long Cervix (Width)
14 Solid line corresponding to the circumference of the cervix
15 Dotted line corresponding to the circumference of the cervix
16 Zipper
17 Indentation in the pillow
18 The pillow indents to the center
19 Positive/negative hook-and-loop fastener of the 2001-333518 pillow (Patent No. 2003-093212)
20 Negative fastener (cervix part)
21 Positive fastener (cervix part)
22 Negative hook-and-loop fastener (head part)
23 Positive hook-and-loop fastener (head part)
24 Movement in the direction of the center
25 Tightening
26 Extends to outside direction
27 Upper side
28 Plastic ring on the end of the short strap of the 2001-333518 pillow (Patent No. 2003-093212)
29 Positive fastener of the 2001-002267 pillow (Utility Model Registration No. 3081155)
30 Negative fastener of the 2001-002267 pillow (Utility Model Registration No. 3081155)
31 Movement to outside direction
32 Ditch in the middle of the two upper panels
33 Pillow covering
34 Pillow covering positive fastener
35 Pillow covering negative fastener
36 Negative fastener (cervical pillow and head part)
37 Zipper (small pillow)
38 Bag small pillow
39 Positive fastener
40 Adjustment for lower or higher height

DETAILED DESCRIPTION OF THE INVENTION

The Neck-Head Support Pillow illustrated in FIG. 1 is divided into three panels. The upper part is divided into two panel 1*a* and 1*b* while the bottom part 3 forms the cervical pillow. FIG. 2 shows a person lying on the pillow facing the ceiling (a). The head fits perfectly in the groove 4 providing maximum support. When the person turns to his/her side, the head will roll to one side of the pillow 1*b* taking the form of the side of the head. The division 2 makes it possible for the panel 1*a* and 1*b* to revert back to its normal rounded shape when the head goes back to the lying-on-back position (a) from lying-on-side position (b). An ordinary pillow (c) will not rebound as easily. The side of the pillow where the head rolled from the lying-on-side position will become thinner 5 than the other side.

FIG. 3 demonstrates positive fastener 34 located at the sides of the pillow covering 33 that controls groove 32 to conform to any size and shape of a person's neck and head. It is possible to regulate the groove 32 by attaching positive fastener 34 of the pillow (c) to the negative fastener 35 affixed to pillow covering 33 in panels 1*a* and 1*b* [Refer to notation 20 and 22 of FIG. 1(*b*) FIG. 11(*c*)(*d*) and FIG. 12(*a*)(*b*)]. In this manner, the neck and head is amply supported providing the user comfortable sleep. (It is possible to adjust the straps 34 in the cover 33 until the desired height and width is reached).

The back of the head of each person is shaped differently, flat or rounded FIG. 4(*a*)(*b*). The cervical pillow part 3 can be adjusted to accommodate the neck.

The length and width of the cervix is different in each person FIG. 5. There are short cervixes with length of 10(*a*) and width of 12(*c*). There are long cervixes with length of 11(*b*) and width of 13(*d*).

The material of the filler (chaff, pipe, etc.) allows it to sink in downward direction 17 making an angle 18 when pushed down by the weight of the head and neck FIG. 6(*a*)(*b*)(*c*). Filler materials (chaff, polyester cotton, sponge, pipe, etc.) can be changed through the zipper 16 located in the outer seams. (Different filler materials can be used depending on the weight preference of the user.)

Mr. Osamu Nakasato's Patent No. 2003-093212 positive fastener 21, placed in the outer seam of the pillow covering at the side of panel 3, is attached to negative fastener 20 FIG. 1(*a*)(*b*). Positive fastener 23, located in the outer seam of the upper panel 1*a* and 1*b*, is attached to negative fastener 22. These fasteners adjust the height of the pillow.

To illustrate, in FIG. 6(*a*)(*b*)(*c*) the pillow sinks in a downward direction 17 and towards the center 18 when a person lies down on it. If this dipping causes discomfort, positive fastener 21 and 23 can be tightened 25 towards the center 24 as in FIG. 8(*a*), FIG. 9(*a*). These adjustments pull the pillow covering 33 in an outward direction 26 thereby increasing the height of the pillow 27 and decreasing the indentation 17 and 18 as shown in FIG. 7(*a*)(*b*)(*c*) FIG. 9(*a*)(*b*).

However, to fit 6.3 Billion different size neck and head, negative fastener is placed at the back pillow covering of the three panels 1*a*, 1*b* and 3 FIG. 10(*a*) where a small pillow 38 can be attached by positive fastener 39(*b*)(*c*). This further facilitates adjustment to fit head and cervix circumference FIG. 5(*e*) comfortably. The small pillow 38 positive fastener 39 FIG. 10(*b*)(*c*) is bonded to negative fastener 36 at the back of the upper part and cervical part of the pillow (a) if the indentation 17 and 18 made by the head FIG. 6(*b*)(*c*) is uncomfortable. The fillers of the small pillow 38 can be increased or decreased through the zipper 37(*b*) to further adjust the height of the pillow. This adjustment can also be achieved without taking any filler in or out of the small pillow 38 but by regulating the fillers of the main pillow instead to fine tune the height 40(*d*) giving added comfort to the neck and head. (The filler of the main pillow can be increased or decreased through the zipper 16. Moreover, the material of the filler can also be changed.)

For example, the sinking process of the pillow when weighed down by the head and neck in FIG. 4(*a*)(*b*) by 6.3 Billion people with different sizes of neck FIG. 5(*a*)(*b*)(*c*)(*d*) and circumference of the cervix (e)(f) can be adjusted by putting fillers in and out through zipper 16.

To make adjustments to the size of the cervical pillow 3, fasteners 19, 28, 29, 30 are placed on the pillow (Utility Model Registration No. 3081155, Patent No. 2003-093212) FIG. 6(*a*)(*b*) FIG. 7(*a*)(*b*). The height can be adjusted by fastening +/− hook-and-loop strap 19 through the plastic rings of straps 28*a*, 28*b*, 28*d* and 28*c* (Patent No. 2003-093212) FIG. 9(*b*). The shoulders are made comfortable by adjusting positive fastener 21 and 23 outwards 31 FIG. 8(*b*) or towards the center 24(*a*). It is possible for the negative fastener 20 to be placed towards the edge of the pillow covering FIG. 9(*a*) or near the center where positive fastener 21 can be bonded to +/− hook-and-loop strap 19 FIG. 6(*b*), or fastened to negative fastener 20 FIG. 1 and FIG. 8 using the same patent No. 2003-093212. The straps provide 6.3 Billion people with 6.3 Billion adjustments to the pillow for easier sleep.

However, in Mr. Osamu Nakasato's Utility Model Registration 3081155 the positive fastener 21 can pass over positive fastener 29 bonded with negative fastener 30 when being attached to negative fastener 20 FIG. 4(*a*) FIG. 7(*a*) FIG. 11(*a*, this will lock positive fastener 29 and negative fastener 30 in place but at the same time will impede easy adjustment. The difference in the increase and decrease in groove 18 and the indentation 17 to panel 1*a*/1*b* and cervical pillow 3 is small. Placing a negative fastener 20 near the outer edge of the pillow outside the negative fastener 30 is also possible even if the movement of positive fastener 21 towards the center 24 and going outwards 31 FIG. 8(*a*)(*b*) is shorter (in making the patent).

It is better and also possible to increase the length of positive fastener 21 and the distance of negative fastener 20 from the outer seam thereby also increasing the distance AB of positive fastener 29 and negative fastener 30 from the outside seam FIG. 11(*b*). (In making the same patent).

But this will be more expensive in terms of the cost of materials during the production stage (cloth, pipe, fastener, etc.). Following the same principle of invention; two fasteners 20 can be placed on each side of the pillow, one on the front and one on the back FIG. 11(*c*)(*d*) FIG. 12(*a*)(*b*), where a positive fastener 21 is not sewn on the covering of the pillow can be attached. By having a positive fastener 21 than can be detached from the negative fastener 20 from the top/front of the pillow makes it easier to increase or decrease the filler material if a zipper 16 is sewn at the sides of the cervical pillow FIG. 12(*a*)(*b*).

(In the principle of invention that does not use the positive fastener 29 and negative fastener 30, the cervical pillow can be adjusted by moving the +/− hoop-and-loop strap towards the center or outwards by the same method of tightening.)

Possible Use in the Health Industry

It is possible for the hollow of the pillow to be adjusted to fit any size of neck and head because of the three-panel division where the cervix is placed in one place and the head is nestled in the two upper panels. The mound of the pillow does not retain a dent when going back to lying-on-back position from sideways position. There is also a small pillow that has positive fastener that can be attached to the negative fastener at the back of the pillow around the middle where the three panels intersect to further adjust the height and width. Fillers of the pillow can also be adjusted to fine-tune the size of the pillow to fit the head and neck comfortably. Mr. Osamu Nakasato's Utility Model Registration 3081155 with Patent No. 2003-093212 fits 6.3 Billion people. It gives people the freedom to adjust the height and width of their pillow to the size they are most comfortable with, which provides refreshing sleep beneficial to general health. (In recent investigation, an adjustable pillow capable of regulating both height and width is not yet available anywhere.)

A pillow where it is possible to adjust the height and width freely, Mr. Osamu Nakasato submitted a pillow that supports the neck and head in Utility Model Registration 3081155 and Patent No. 2003-093212. A hollow is created in the center of the pillow by dividing it into three parts; two panels for the head part together with the cervix part as the third, where the head of the user is nestled and the neck supported by the cervix part giving utmost comfort to the user. Even if the user moves from lying-on-the-side to lying-on-the-back the distortion created in one panel of the pillow will not stay on it but will retain its mound.

Moreover, even if the head part of the pillow is divided in two (pillow divided into three including the cervix part), it is not enough to adjust it to fit the various shapes and size of head and neck perfectly, especially because pillows with filler materials lacking in elasticity (such as chaff, pipes, etc.) does not go back to its original shape after it sinks under the weight of the head. Negative fasteners are attached to the back of the pillow for the neck and head part. Positive fasteners are attached to the outer seams of in the head and neck divisions that can be bonded to the negative fasteners. By adjusting the fasteners outwards the sinking made by the weight of the head will be increased and adjusting them towards the center will reduce the sinking. A small pillow with positive fasteners can be attached to the negative fasteners at the middle of the pillow where the three panels intersect to further adjust it to fit various neck and head size and shape. This neck-head support pillow adapts itself to the neck and head of 6.3 billion people.

We claim:

1. A pillow, comprising:

two side panels removably attached to each other along a generally straight first seam to receive the head of a user therein;

a bottom panel for supporting the neck of the user and removably attached to the side panels along a second seam that is substantially perpendicular to the first seam; and at least two cooperating adjustable fasteners attached to an exterior of at least one of the side panels and the bottom panel, wherein the two cooperating adjustable fasteners engage one another for adjusting the at least one of the side panels and the bottom panel.

2. The pillow of claim 1, wherein the side panels are each formed with an indentation abutting the first seam for receiving the head of the user therein.

3. The pillow of claim 1, further comprising: adjustable fasteners attached to two or more of the side panels and the bottom panel for engaging one adjustable fastener to another adjustable fastener to adjust the pillow.

4. The pillow of claim 1, further comprising: an insert received at the intersection of the seams to support the head of the user.

* * * * *